United States Patent [19]

Gundlach

[11] Patent Number: 4,807,820

[45] Date of Patent: Feb. 28, 1989

[54] SEGMENTAL SHELL FOR A COAL CRUSHER ROLL

[75] Inventor: Theodore F. Gundlach, Belleville, Ill.

[73] Assignee: T.J. Gundlach Machine Company, Belleville, Ill.

[21] Appl. No.: 895,198

[22] Filed: Aug. 11, 1986

Related U.S. Application Data

[62] Division of Ser. No. 586,571, Mar. 5, 1984, Pat. No. 4,617,709.

[51] Int. Cl.[4] ..... B02C 13/26

[52] U.S. Cl. ..... 241/294; 241/300; 29/124

[58] Field of Search ..... 29/124; 241/243, 294, 241/300

[56] References Cited

U.S. PATENT DOCUMENTS 2,588,900 3/1952 Warsmith ..... 241/294

2,803,411 8/1957 Pollitz ..... 241/294

FOREIGN PATENT DOCUMENTS 780489 8/1957 United Kingdom ..... 241/294

*Primary Examiner*—Timothy V. Eley

*Attorney, Agent, or Firm*—Cohn, Powell & Hind

[57] ABSTRACT

A coal crusher roll includes a smooth tubular cylindrical back-up roll having a series of regularly spaced tapped radial holes to receive bolts by which eight identical shell segments may be fastened on the back-up roll. The holes at the axial ends of the segments are undercut to provide a rabbet into which fits the tang of a special lifting hook by which the segment can be easily handled by a lightweight crane. A recess in the central part of the segment defined by a peripheral berm around the backside of the segment reduces the weight of the segment, provides a place for receiving balancing weights, and simplifies the face fit machining for the segment with the back-up roll.

6 Claims, 3 Drawing Sheets

SEGMENTAL SHELL FOR A COAL CRUSHER ROLL

BACKGROUND OF THE INVENTION

This application is a divisional of Ser. No. 586,571, filed Mar. 5, 1984 now U.S. Pat. No. 4,617,709.

Coal crushers have been available and in use for many years for breaking coal into small pieces suitable for handling and burning. The best crushers available are capable of breaking the coal into precisely the desired range of particle sizes which are best for the particular application such as pipeline transportation or particular coal preparation plants. The breaking of the coal into precisely desired sizes is done by passing the coal between two crusher rolls which have intermeshing teeth which are spaced apart a certain distance axially and circumferentially so that the coal is broken to the desired size, with minimal production of "fines."

After a period of use, the chisel teeth on the crusher rolls wear down to the extent that the coal pieces passing through the crusher exceed the desired size. When this happens, it is necessary to correct the situation either by building up the teeth on the crusher rolls by welding or by replacing the rolls altogether. In either case, it is necessary to remove the roll and replace it with a new or repaired roll while the worn roll is being repaired or replaced.

Removal of the roll from the coal crusher necessitates that the crusher be taken out of service while the rolls are being replaced. It is therefore desirable that the roll replacement process be as fast as possible to reduce the amount of time that the coal crusher is out of service. However, coal crusher rolls are extremely large and heavy, especially for large, efficient machines, and the process of removing a roll is a lengthy one. It requires the disassembly and/or disconnection of the roll bearings and the drive mechanism and requires very careful and precise manipulation of the large heavy roll by a large crane. Because of the size and mass of the roll, the process of removing a roll must be done with great care to prevent damage to surrounding equipment, to the roll itself, and to the workers in the vicinity. The replacement of the roll is just as difficult and ticklish a business as the removal of the roll and the entire roll replacement process could take several days. In the time that this work is under way, the coal crusher is out of operation with resulting economic loss and loss of production.

It has been proposed in the past to make coal crushers with removable roll segments. The removable roll segments of the prior art have suffered from numerous disadvantages which have retarded their acceptance by the industry. One problem is the achieving of a close face fit between the roll segment and the roll on which it is mounted. Unless this face fit is extremely precise, the cyclic forces on the roll segment can cause it to fret and abrade the roll on which it is mounted and can also cause fatigue of the fasteners by which the segment is attached to the roll. The prior art has attempted to solve that problem by various strategems, such as zinc coating and precision machining, but these strategems are expensive and not always successful.

Because of the extreme vibration encountered in a coal crusher, the fasteners which hold the segments to the roll must be extremely resistant to becoming loose under vibration. This problem has been recognized in the past and has been approached by using lock nuts on the attachment bolts to lock the nut in place, by cotter pins through the end of the bolt or other similar techniques. These are undesirable because of the greatly increased time required to secure the fastener and also because, while these techniques prevent the attachment bolts from falling out of the machine altogether, they do not always prevent them from becoming loose. The loose bolts are useless to hold the segment in place and allow it to flex and fret against the support roll.

Prior art coal crushers with removable segments have utilized ribs or splines in the backside of the segment which fit into corresponding grooves running axially along the roll face to prevent circumferential forces exerted on the segments during crushing from shearing the attachment bolts. The cost of special machining in the support roll and corresponding difficulties in ensuring the correct placement and size of the ribs in the segment casting has greatly increased the cost of the removable segment system, but it or some variant of this scheme for carrying circumferential stresses has usually been considered necessary because the shearing of the attachment bolts on the segments can result in catastrophic failure of the crusher and require replacement of the entire crusher.

SUMMARY OF THE INVENTION

Accordingly, it is an object of this invention to provide a roll for a coal crusher having removable segments which are easily and quickly removed and replaced without removal of the crusher roll from the machine.

It is another object of this invention to provide a segment for a coal crusher roll which is inexpensive to produce but reduces or eliminates circumferential shear forces from acting on the attachment bolts.

It is another object of this invention to provide a segment for a coal crusher roll which has an attachment which locks into a receptacle on the segment which is protected from wear in use.

It is a further object of this invention to provide a segment for a crusher roll having a reduced weight, a simplified system for ensuring a precise face fit to the support roll, and a simple and effective means for balancing the crusher roll.

It is yet another object of this invention to provide a removable segment suitable for use in roll crushers generally suitable to crush hard or rock-like materials which are equivalent to coal, for example, coke, stone or ores or other material that may be crushed by means of a roll crusher.

The objects of the invention are attained in the preferred embodiment of a coal crusher roll having a smooth tubular cylindrical backup roll having a series of regularly spaced radial holes drilled through the roll and tapped to receive bolts. A series of identical segments may be mounted on the back-up roll with machine screws provided on their threads with an anaerobic adhesive. The segments are provided with counterbored holes which align with the holes in the back-up roll to receive the screws and attach the segments to the roll. The holes at the axial ends of the segments are undercut to provide rabbets that enable special lifting hooks to be placed in the bolt holes while the segment is still fastened to the back-up roll with the other bolts. The lifting hook enables the segment to be easily handled by a lightweight crane, and the undercut rabbet and tang arrangement makes it possible to insert or remove the hooks when the segment is attached to the backup rolls so that the segment may be supported by the hooks while the bolts are being removed, and may also be maneuvered into position and bolted in place without first removing the hooks. A recess in the central part of the segment defined by a peripheral berm around the backside of the segment reduces the weight of the segment, provides a place for receiving balancing weights, and simplifies the face fit machining or casting for the segment with the backup roll. The peripheral berm also reduces the surface area contact with the back-up roll so that the force exerted by the attachment screws is concentrated over a smaller area and, therefore, the pressure between the segment and the back-up roll in the region of the attachment bolts is much greater than would otherwise be the case, thereby providing a greater force to resist the circumferential force exerted on the segment in use so that the attachment bolts are subjected to a reduced shear force.

DESCRIPTION OF THE DRAWINGS

The invention and its many attendant objects and advantages will be better understood upon reading the following description of the preferred embodiment in conjunction with the following drawings, wherein.

DESCRIPTION OF THE PREFERRED EMBODIMENT

Figure 1:
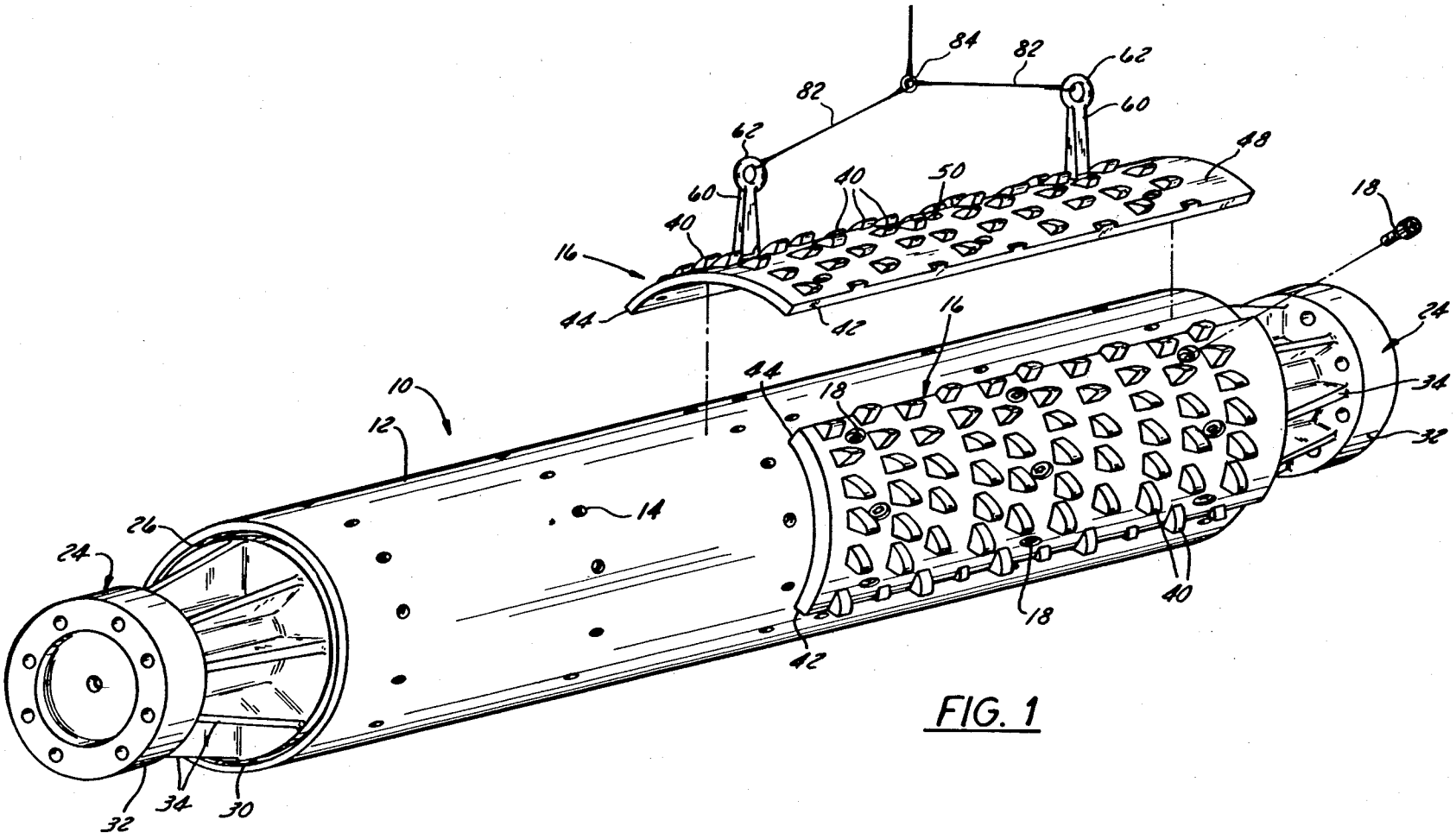
FIG. 1 is a perspective view of a crusher roll made in accordance with this invention showing one segment attached to the roll and a second segment being removed by the special lifting hooks made for this purpose.
Figure 2:
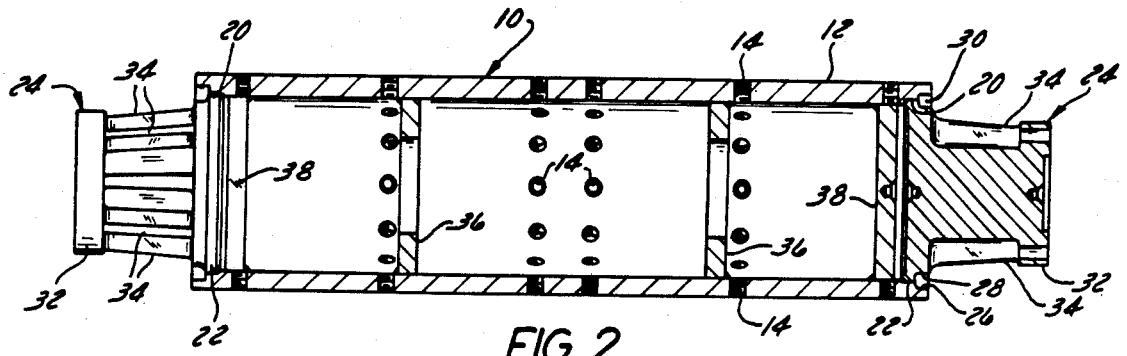
FIG. 2 is a sectional elevation of the back-up roll for the crusher roll shown in FIG. 1.

Referring now to the drawings wherein like reference numerals identify identical or corresponding parts, and more particularly to FIGS. 1 and 2 thereof, the back-up roll 10 for the crusher roll illustrated is shown as a cylindrical tube 12 through which are drilled a series of regularly spaced holes 14. The placement of the holes 14 in the back-up roll will be explained in particular in connection with a description of removable segments 16 which are fastened by bolts 18 to the back-up roll 10. It will be understood from the following detailed description of the present invention that the terms coal crusher, breaker roll and coal crusher roll used herein refer not only to coal crushers, but include equivalent crusher or breaker apparatus suitable for use in the crushing of hard or rock-like materials which are similar to coal, for example, coke, stone or other ores or material that may be crushed by means of a roll crusher.

As shown in FIG. 2, each end of the cylindrical tube 12 has two annular recesses machined into the end of the tube. An inner recess 20 is machined to receive an inner end rim 22 of a hub 24. An outer recess 26 cooperates with a corresponding recess 28 in the rim 22 of the hub 24 to provide an annular groove 30 in which the hub can be securely welded to the cylindrical tube 12. The outer end of the hub 24 is provided with peripheral flange 32 by which the hub can be attached to a suitable bearing and drive structure. A series of longitudinal vanes or flutes 34 is provided between the rim 22 and the outer flange 32 for additional strength of the hub 24.

A series of radial stiffeners 36 (two being shown in FIG. 2) in the form of heavy annular rings is provided at approximately $\frac{1}{3}$ the length of the tube inside and are welded in place by a peripheral weld. A diagonal bar 38 is welded across each end of the cylindrical tube 10 primarily for ease of handling during manufacturing. The ends of the tube are radially supported by the solid end of the hub 24 and the radial stiffeners 36 support the tube at the $\frac{1}{3}$ positions. The tube itself is extremely strong because it does not have grooves or other configurations cut into it for circumferential support of the segments and, therefore, it does not suffer from the stress peaking problems which such configurations could cause in a tubular back-up roll. Accordingly, the crusher roll of this invention provides exceptional strength without undue weight.

Figure 3:
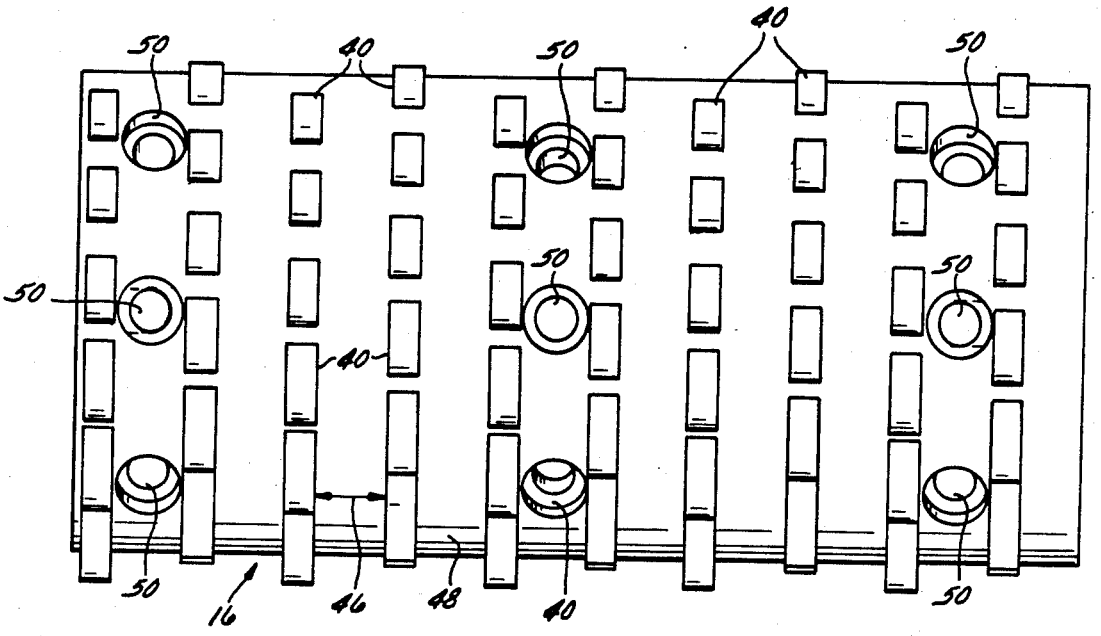
FIG. 3 is a plan view of one of the segments shown in FIG. 1.
Figure 4:
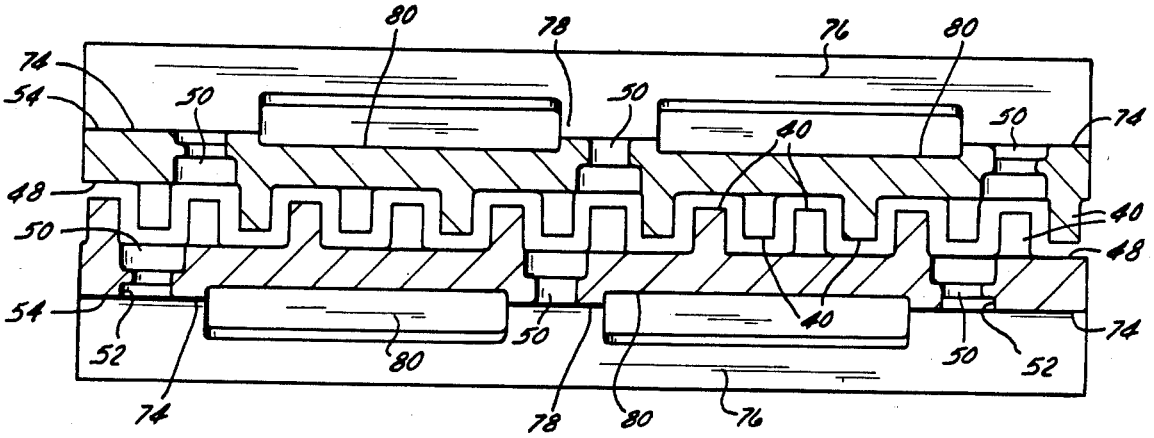
FIG. 4 is a sectional elevation of two meshing segments of the type shown in FIG. 2.
Figure 5:
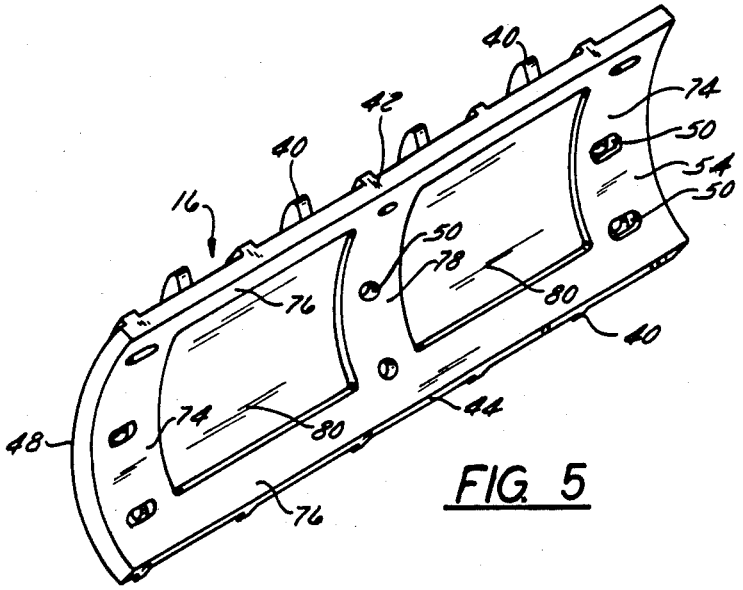
FIG. 5 is a perspective view of the backside of the segment shown in FIGS. 3 and 4.

Turning now to FIG. 3, a removable segment 16 for the inventive crusher roll is shown having a series of chisel teeth 40 arranged in ten columns of six teeth each. The teeth in adjacent rows are staggered $\frac{1}{2}$ pitch so that each tooth 40 is axially aligned with the space between two teeth in the adjacent columns. Five of the columns have six complete teeth and the other five columns have five complete teeth and two partial teeth. As shown, for example, in the second column from the left-hand edge in FIG. 3, and more particularly as shown in the same column in FIG. 1, the partial teeth along the leading circumferential edge 42 match up to the partial teeth along the trailing circumferential edge 44 of the adjacent segment to form a complete tooth 40. This preserves the circumferential spacing between all of the teeth on the breaker roll and prevents voids while making it possible to have the leading and lagging circumferential edges be straight.

The axial space 46 between the centerlines of adjacent columns of teeth 40 is equal to about three times the axial thickness 47 of the teeth. In use, the breaker roll of the coal crusher is placed parallel to and horizontally spaced from another breaker roll and positioned so that the teeth of the other breaker roll are positioned exactly in the center of the spaces 46 between the teeth in this breaker roll, and vice versa. The breaker rolls are mounted in the machine so that the horizontal spacing between them is adjustable. By adjusting the horizontal distance between the two breaker rolls, it is possible to control the size of the particles of the output coal stream.

The sum of the distances A+B between the centerline of the column of teeth adjacent each circumferential edge of the segment and the circumferential edge of the segment itself is equal to the axial spacing 46 between adjacent columns of teeth on the segment. In this way, the segments, when attached to the back-up roll 10, will continue the same spacing between adjacent columns of teeth as exist in each segment individually.

Nine holes are drilled in the segment in a uniform pattern as shown. The holes are in the form of three circumferentially aligned columns and three axially aligned rows. The sum (C+D) of the distance (C) between the right-hand column of holes and the right-hand circumferential edge of the segment, plus the distance (D) between the left-hand column of holes and the left-hand circumferential edge of the segment is equal to $\frac{1}{4}$ of the distance between the right and left columns of holes and is equal to ½ the distance between adjacent columns of holes. The spacing of the holes may also be described by referring to the back-up roll 12 as a cylinder having a circumference, and each curved segment 16 as comprising a quarter of that circumference. The aforementioned nine holes may be referred to as being arrayed in three axially extending rows, comprising a top row adjacent edge 42, a center row and a bottom row, adjacent edge 44. The center row is spaced about 30° each from the adjacent top and bottom rows. The top and bottom rows are each spaced about 15° from the adjacent edges 42 and 44, respectively, of the segment 16. The purpose of this hole spacing is as follows:

1. Once the back-up rolls are mounted in the machine, there is only one possible way of mounting the segments. It is impossible to mount the segments on the rolls backwards or so that the teeth would interfere because the segments then would be shifted axially with respect to the backup roll and it would be obvious that they were being put on incorrectly.

2. It provides an ideal spacing for the holes on the segment so that they are near, but not too near, the edges of the segment, and the two center columns of holes in the back-up roll are not so close together to weaken the back-up roll.

3. A single segment can be used for all positions on both back-up rolls in the machine and identical back-up rolls can be used in both positions in the crusher, just switched end-forend. The holes in the backup rolls are positioned to ensure that the segments are aligned with the axial ends of the back-up roll and the ½ spacing of the two center columns of holes in the roll ensures that the teeth on the other roll will be exactly aligned between the teeth on the first roll when the second roll is switched end for end with the first roll.

Each of the holes in the two end columns is provided with a special rabbet 52 where the hole opens on the inside face 54 of the segment 16. The rabbet 52 is formed by counterboring the holes 50 where they open in the inner face 54 of the removable segment 16. The counterboring is done with a cutting tool having the same diameter as the holes 50, but on a centerline which is shifted at least about ½ of the radius of the holes 50 in the outward axial direction only to ensure that the lifting hook will be inserted properly with the hook tang facing outwardly. This produces an elongated rabbet having a width equal to the diameter of the holes 50.

Figure 6:
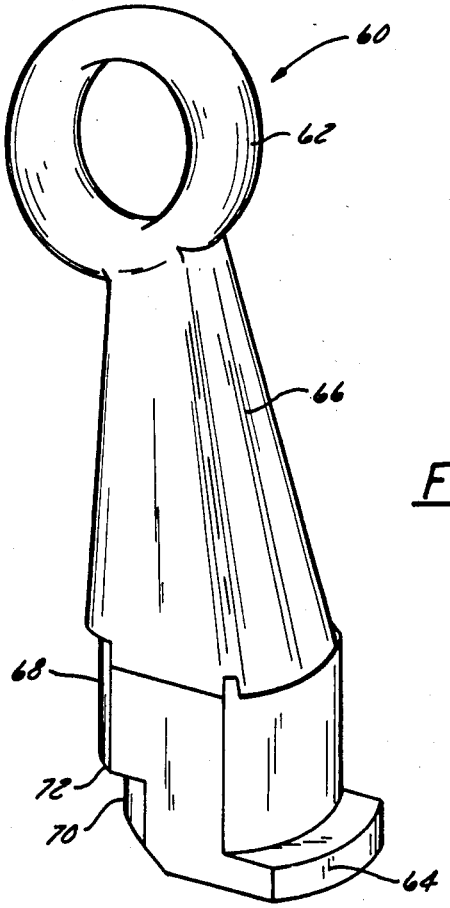
FIG. 6 is a perspective view of the lifting hook shown in FIG. 1.

A lifting hook 60, most clearly shown in FIG. 6, includes a top end ring 62 and a bottom end tang 64 at opposite ends of a hook body 66. In use, two or four of the hooks will be used to manipulate the segment, two being used as shown in FIG. 1. The orientation of the hook shown in FIG. 1 will be used to give positional names to the parts of the hook. For example, in use the end ring will be facing upward and therefore will be called the top end ring, and the tang 64 will be at the bottom end and therefore is called the bottom end tang. The center of the top end ring is displaced from the centerline of the hook body 66 toward the center or inside of the segment when the hook is in use and therefore the edge of the hook toward which the ring is displaced will be called the inside edge, and the opposite edge will be called the outside edge.

As shown most clearly in FIG. 6, the inside edge of the hook 60 is aligned with the center of the top end ring 62, and the outside edge of the hook body 66 is tangent to the hole in the top end ring 62. This ensures that the stress lines at the outside portion of the end ring 62 will be smooth and continuous with no discontinuities for maximum strength of the ring. The lifting hook 60 may be a one piece forging or may be cast or flame cut.

The hook body 66 flares smoothly down to a rounded rectangular base portion 68. A notch 70 is formed in the base portion to provide a ledge 72 which engages the shoulder formed by the counterbore of the counterbored holes 50. The tang 64 projects outwardly in the direction opposite from the offset of the end ring 62. The tang 64 is rounded with a radius of curvature approximately equal to the radius of curvature of the rabbet s it fits neatly into the rabbet 52 and the ledge 72 of the notch 70 engages the shoulder of the top counterbore of the holes 50. When the cable shown in FIG. 1 exerts an inward and upward pull on the end ring 62, the tang 64 and the shoulder 72 lock securely in place in the counterbored hole 50 to secure the lifting hook in place until the cables are removed. Only by tilting the hook in the same direction in which it was tilted to insert the hook in the counterbored hole 50 may the lifting hook 60 be removed from the hole.

The inner face 54 of the removable segment 16 is provided with a circumferential peripheral berm 74 along both circumferential edges of the segment, and an axial peripheral berm 76 along both leading and lagging axial edges 42 and 44 of the segment. In addition, a central berm 78 is provided parallel to the circumferential berms 74 and connecting the leading and lagging axial berms 76. Two square recesses 80 are defined between the berms. The recesses 80 provide a means for reducing the metal content of the segment and thereby reducing its weight and cost, and also they provide a receptacle for placing balancing weights between the segments and back-up roll to ensure that the breaker rolls will be balanced in use so as not to exert undue unbalanced forces on the bearings and run smoothly with minimal vibration.

The berms are radially aligned with the counterbored holes 50 in the segment and provide a means for securely fastening the segment to the back-up roll 10. When the screws are passed through the holes 50 and are threaded tightly into the threaded holes 14 in the back-up roll, they exert an enormous force on the segment against the back-up roll. Because of the relatively restricted size of the berm, this force is carried entirely by a relatively small area and consequently the pressure at the interface between the berm and the back-up roll is enormous. Since the segment is harder material than the back-up roll, the microscopic strain tends to embed the berm of the segment slightly into the surface of the back-up roll or to closely interengage the surface aspirities of the facing surfaces of the berms and the back-up roll so that the frictional force, which is very great in any case, is actually increased because of the embedding or interengaging effect. The result is that the frictional force between the segment and the back-up roll is so great that the circumferential forces acting on the segment during the crushing process are largely carried by this frictional force so that little or no shear forces are exerted on the bolts.

In operation, lifting hooks are placed in the outer circumferential columns of holes at both ends of the segment and the top end rings 62 of each of the lifting hooks 60 ar connected by cables 82 only slightly longer than the segment. This ensures that a strong axial force will be exerted on each hook to securely lock it in place and prevent accidental disengagement.

The cables 82 are connected in the middle by a ring 84 and lifted from the ring 84 by a crane. The segment is lifted by the crane into position on the back-up roll 10 and is secured in position by two or more screws while it is supported by the hooks. Once attached, the listing force is relieved and the hooks 60 may be removed by merely tilting them outward away from each other and lifting them clear of the hole 50. Each of the other segments is similarly secured in position. While the segments are being attached to the backup roll, it is held in angular position against rotation which would occur because of massive unbalance when some but not all of the segments are attached to the roll.

When all of the segments are attached, the roll is turned freely and, if it is unbalanced, a set of test weights is attached by the screws 18 until the approximate balance is achieved. Then the segments where the weights are to be attached are removed and the weights are placed in the recesses 80. A convenient form of balance weight is a curved plate equal or slightly smaller in size to the recesses 80 so that the plate need merely be placed and fastened in position. Once the balance weights have been placed, all of the bolts are coated with an anaerobic adhesive such as Locktite 277 and are threaded into position. The bolts are then torqued down firmly to provide the required radial force. Eight hundred foot pounds of torque or greater on a 1½ inch screw with six threads per inch has been found to exert a sufficient radial force on nine equally spaced positions on a 420 pound segment to hold it securely in position.

Obviously, numerous modifications and variations of the above-identified invention will occur to those skilled in the art in light of this disclosure. For example, it will be understood that the present invention is not limited to use with coal crushers but will be suitable for use in roll crushers generally suited to crush hard or rock-like materials which are equivalent to coal, such as, coke, stone, or other ores or material that may be crushed by means of a roll crusher. Accordingly, it is expressly to be understood that these modifications and variations and the equivalents thereof may be practiced while remaining within the spirit and scope of the invention as defined by the following claims.

I claim:

1. A removable segment for a coal crusher having a cylindrical back-up roll adapted to receive a plurality of said segments, said segment comprising:

a curved metal member in the form of a sector of a cylindrical tube having inner and outer cylindrical faces, and having teeth formed on said outer cylindrical face;

a recess in said inner cylindrical face for weight reduction, for simplifying the face fit of the segment on the back-up roll, and for receiving balancing weights; said recess defined by a raised peripheral berm on all four sides of said segment;

radial holes in said segment around the periphery thereof through said berm for receiving bolts which thread into tapped holes in said back-up roll for attachment of said segment to said roll, said segment having a coaxial counterbore at said outer face for receiving the heads of said bolts.

2. A removable segment for a coal crusher having a cylindrical back-up roll adapted to receive a plurality of said segments, said segment comprising; a curved metal member in the form of a sector of a cylindrical tube having inner and outer cylindrical faces, and having teeth formed on said outer cylindrical face;

a recess in said inner cylindrical face for weight reduction, for simplifying the face fit of the segment on the back-up roll, and for receiving balancing weights; said recess defined by a raised peripheral berm on all four sides of said segment;

radial holes in said segment around the periphery thereof through said berm for receiving bolts which thread into tapped holes in said back-up roll for attachment of said segment to said roll, said segment having a coaxial counterbore at said outer face for receiving the heads of said bolts, and at least two rabbets in said inner face where at least two of said holes open in said inner face, said rabbets in said two holes facing in opposite directions so as to be engaged by hooks inserted through said two holes and used to lift said segment.

3. The segment defined in claim 1, further comprising a substantially central circumferentially extending berm connecting the sections of said peripheral berm on exially extending leading and lagging edges of said segment, said peripheral and central berms being configured to lie flush against said back-up roll said connecting berm also including radial holes for receiving bolts which thread into tapped holes in said back-up roll.

4. The segment defined in claim 3, wherein the berm on one axial end of said segment is substantially wider than the berm on the other axial end of said segment, and said recess is divided into two substantially equally sized substantially square recesses by said central berm, said segment subtending an angle of 90° whereby the breaker roll made by said segments and said back-up roll may be dynamically balanced.

5. A removal shell segment for a back-up roll of a coal crusher, comprising:

a curved metal member in the shape of a sector of a cylindrical tube having a concave face on the inside, facing toward said back-up roll when mounted thereon, and a convex face on the outside, facing aay form said back-up roll when mounted thereon;

a plurality of radial holes in said member for receiving fasteners by which said member may be fastened to said back-up roll;

at least one recess in said concave face defined by an axially extending raised berm along each leading and lagging axially extending edge of said member and a circumferentially extending berm along each circumferentially extending edge of said member;

said holes extending through said berms and opening on said convex face in cylindrical counterbores;

at least four of said holes being through said circumferentially extending berms at the axial ends of said member, said end holes having means at the opening thereof in said concave face defining a rabbet extending from said hole toward the adjacent circumferentially extending edge;

said four end holes being aligned in two circumferentially extending end columns adjacent the axial end edges of said member, said columns being spaced from their adjacent edges a combined axial distance equal to ¼ the axial distance between said columns.

6. A removable segment for a coal crusher having a cylindrical back-up roll adapted to receive a plurality of said segments, said segment comprising:

a curved metal member in the form of a sector of a cylindrical tube having inner and outer cylindrical faces, and having teeth formed on said outer cylindrical face;

a recess in said inner cylindrical face for weight reduction, and for simplifying the face fit of the segment on the back-up roll, said recess defined by a raised peripheral berm on all four sides of said segment;

radial holes in said segment around the periphery thereof through said berm for receiving bolts which thread into tapped holes in said back-up roll for attachment of said segment to said roll, said segment having a coaxial counterbore at said outer face for receiving the heads of said bolts.

* * * * *

UNITED STATES PATENT AND TRADEMARK OFFICE

CERTIFICATE OF CORRECTION

PATENT NO. : 4,807,820

DATED : February 28, 1989

INVENTOR(S) : Theodore F. Gundlach

It is certified that error appears in the above-identified patent and that said Letters Patent is hereby corrected as shown below:

Column 6, line 13, after "rabbett" first occurence delete "s" and insert --so--.

Column 8, line 41, delete "aay form" and insert --away from--.

Signed and Sealed this

Twenty-ninth Day of August, 1989

*Attest:*

DONALD J. QUIGG

*Attesting Officer*

*Commissioner of Patents and Trademarks*